US007730575B2

(12) United States Patent
Huang

(10) Patent No.: US 7,730,575 B2
(45) Date of Patent: Jun. 8, 2010

(54) STRUCTURE FOR A HAND TROWEL HANDLE WITH ADJUSTABLE ROTATIONAL ANGLE

(76) Inventor: Chin-Chen Huang, 12, 41st Road, Industry Zone, Shitun District, Taichung (TW)

( * ) Notice: Subject to any disclaimer, the term of this patent is extended or adjusted under 35 U.S.C. 154(b) by 1118 days.

(21) Appl. No.: 11/334,497

(22) Filed: Jan. 19, 2006

(65) Prior Publication Data

US 2007/0163067 A1 Jul. 19, 2007

(51) Int. Cl.
*B05C 17/10* (2006.01)

(52) U.S. Cl. ..... 15/235.8; 15/235.4

(58) Field of Classification Search ..... 15/235.4–235.8, 15/144.1, 245.1; 425/458
See application file for complete search history.

(56) References Cited

U.S. PATENT DOCUMENTS 4,155,141 A * 5/1979 Guerra ..... 15/235.8
4,254,980 A * 3/1981 Anderson ..... 294/15
5,467,496 A * 11/1995 Jarvis ..... 15/235.8
5,687,448 A * 11/1997 Dye, Jr. ..... 15/235.8
6,247,204 B1 * 6/2001 Hamby et al. ..... 16/436
6,499,178 B1 * 12/2002 Huang ..... 15/235.4
7,010,828 B1 * 3/2006 Flores et al. ..... 15/235.3

* cited by examiner

*Primary Examiner*—Dung Van Nguyen
(74) *Attorney, Agent, or Firm*—Rabin & Berdo, P.C.

(57) ABSTRACT

The invention relates to a structure for a hand trowel handle with adjustable rotational angle on the grasping section. The hand trowel is composed of a blade, a connecting section and a grasping section. The connecting section uses its base to connect with the tongue on the blade. The structure for the grasping section with adjustable rotational angle features mainly in the radial toothed rings at the front end of the grasping section and at the supporting end of the connecting section. When the grasping section is worn on the shaft in the center if the radial toothed ring of the connecting section, the grasping section can be tightened or loosened through the adjustment knob, the spring and the shaft in the accommodating hole. Thus, the rotational angle between the grasping section and the shaft can be adjusted.

3 Claims, 3 Drawing Sheets

STRUCTURE FOR A HAND TROWEL HANDLE WITH ADJUSTABLE ROTATIONAL ANGLE

BACKGROUND OF THE INVENTION

1. Field of the Invention

The invention relates to the tools for cement work or glue work. Especially, it relates to a structure for a hand trowel handle with adjustable rotational angle. The structure provides the ability to adjust the angle between the handle and the blade. Thus, an appropriate grasping is achievable to operate the hand trowel under any work condition.

2. Description of the Prior Art

In a construction project, either wall finishing work (surface cement) or glue work (carpeting, tile paving) needs a hand trowel. Due to lengthy work time, the handle for a common hand trowel is designed to be soft and easy hand-grasping. Thus, the worker can easily and smoothly finish the work. Please refer to U.S. Pat. No. 6,499,178 B1 for an assembly structure for a hand trowel. Its grasping section of the handle is made of soft resin material, so it provides a firm, easy and slip-proof grasp. Its handle can be assembled and disassembled quickly with a base and a blade tongue. Thus, the handle can work with blades in different shapes and areas. In a real hand trowel work, it is common to have different angles among different architectural object surfaces. The hand trowel needs to change angle during the work. If the grasping handle does not adjust angle with the object surface, it will create inconvenience and difficulty for the worker to operate the trowel. Therefore, the invention makes improvement over this apparent shortcoming, which is also the motive for the present invention.

SUMMARY OF THE INVENTION

The objective of the present invention is to provide a structure for a hand trowel handle with adjustable rotational angle. The grasping section is worn on the shaft of the connecting section. The toothed ring on the front of the grasping section matches the toothed ring on the supporting end of the connecting section. Through the adjustment knob and spring in the accommodating hole at the rear end, the grasping section can be adjusted tightly or loosely over the shaft. Therefore, the rotational angle for the grasping section over the shaft can be adjusted.

To achieve the objective, the structure for a hand trowel handle with adjustable rotational angle on the grasping section includes a connecting section, a grasping section, a spring, an adjustment knob. The connecting section and the base form one integrated body. The supporting end for the connecting section has toothed ring, which center has a shaft. At the end of the shaft, there is a screw section. The shape for the grasping section matches human hand. There is a toothed ring at the front end of the grasping section. The grasping section is worn on the shaft that is mounted on the connecting section. A spring is set inside the accommodating hole at the rear end of the grasping section. An adjustment knob connects with the shaft in the accommodating hole at the rear end of the grasping section. Through rotation of adjustment knob, spring is tightened or loosened at the inner side of the accommodating hole in the grasping section. Thus, the grasping section is properly worn on the shaft of the connecting section and able to conveniently adjust the rotational angle.

DETAILED DESCRIPTION OF THE PREFERRED EMBODIMENT

To further describe the technical approach to achieve the above objective of the present invention, a preferred embodiment is given below as an example: Please refer to FIGS. 1, 2 and 3. The basic structure for the hand trowel in the invention is similar to the one in U.S. Pat. No. 6,499,178B1 and composed of a blade 10, a connecting section 20 and a grasping section 30. The blade 10 can be in various kinds of shape and area. The connecting section 20 and the base 21 form one integrated body. The connecting section 20 uses a base 21 to connect with tongue 11 on the blade 10, so blades 10 in different shapes and areas can be used. The structure for adjustable rotational angle for the grasping section has features: the supporting end 22 for the connecting section 20 has a radial toothed ring 23 and a shaft 24 in the center of the toothed ring 23. The end of the shaft 24 has a screw section 25. The surface for the grasping section 30 is made of soft and slip-proof material and matches human hand shape. The front end has a radial toothed ring 31, while the rear end has an accommodating hole 32. Inside the grasping section, there is a through-hole 33 running through the toothed ring 31 and the accommodating hole 32. The grasping section 30 is worn on the shaft 24 of the connecting section 20 through the through-hole 33. The screw section 25 at the end of the shaft 24 can be placed in the accommodating hole 32 at the rear end of the grasping section 30. The toothed ring 31 at the front end of the grasping section 30 matches toothed ring 23 on the supporting end 22 of the connecting section 20. A spring 40 is set in the accommodating hole 32 at the rear end of the grasping section 30. The adjustment knob 50 is part of a terminal 51, which is inserted into the accommodating hole 32 at the rear end of the grasping section 30. The adjustment knob 50 is tightened with the screw section 25 at the end of the shaft 24 through the screw hole 52;

According to the above description, the adjustable rotational angle for the grasping section in the present invention has its grasping section 30 being worn on the shaft 24 of the connection section 20 that links to the blade 10. The toothed ring 31 at the front end of the grasping section 30 matches the toothed ring 23 on the supporting end 22 of the connecting section 20. Through the function of the spring 40 and the adjustment knob 50 in the accommodating hole 32 at the rear end of the grasping section 30, the grasping section 30 can be adjusted tightly or loosely against the connecting section 20, as shown in FIG. 3. By loosening the adjustment knob 50, the rotational angle is adjusted between the grasping section 30 and the blade 10. Or by tightening the adjustment knob 50, the toothed rings 23 and 31 between the grasping section 30 and the connecting section 20 can be matched. Thus, the invention provides adjustable grasping section 30 based on working surface angle. Thus, the worker can operate the hand trowel properly to work on different angles without difficulty.

Figure 1:
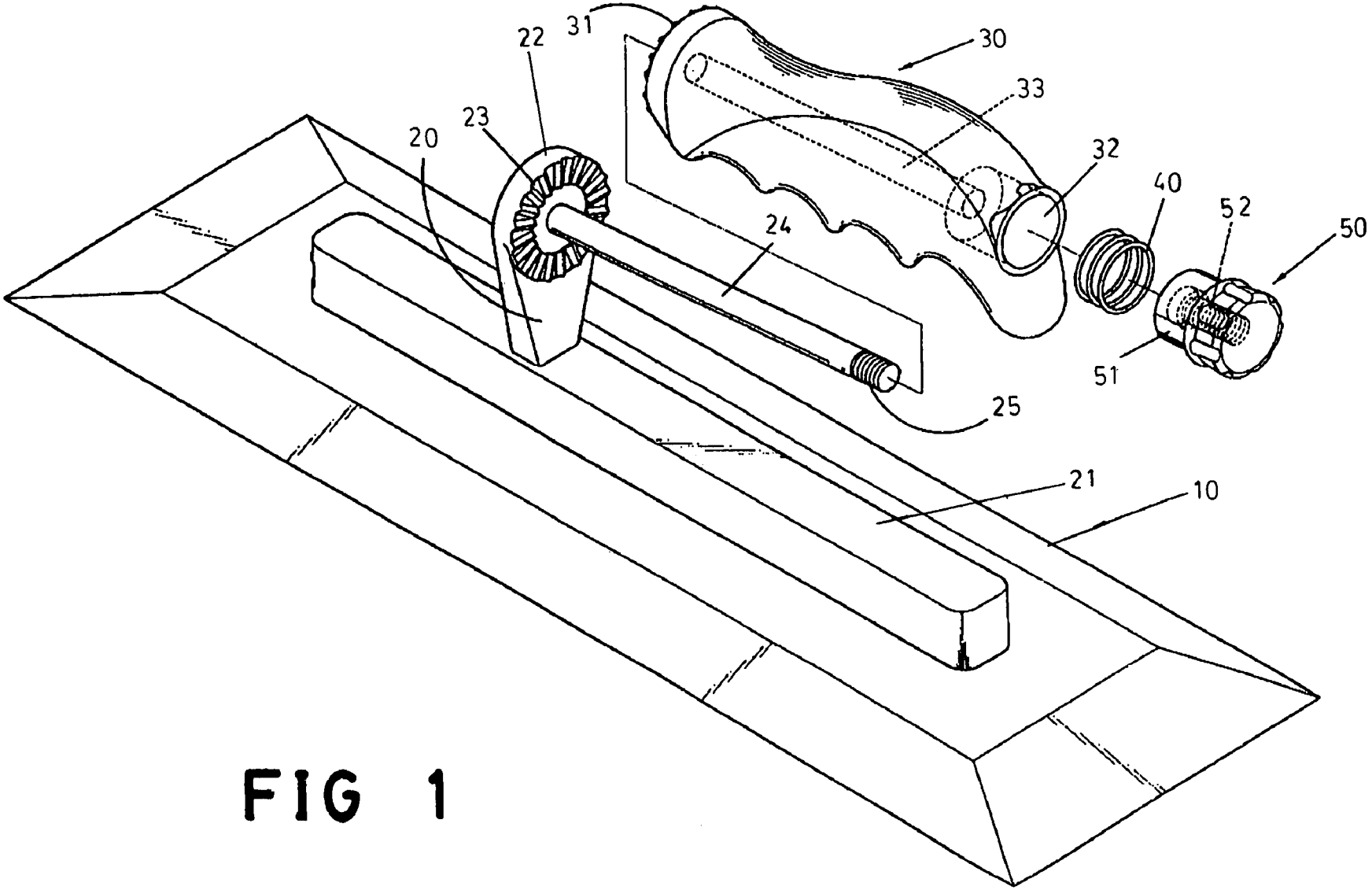
FIG. 1 is the three-dimensional diagram for the invention.
Figure 2:
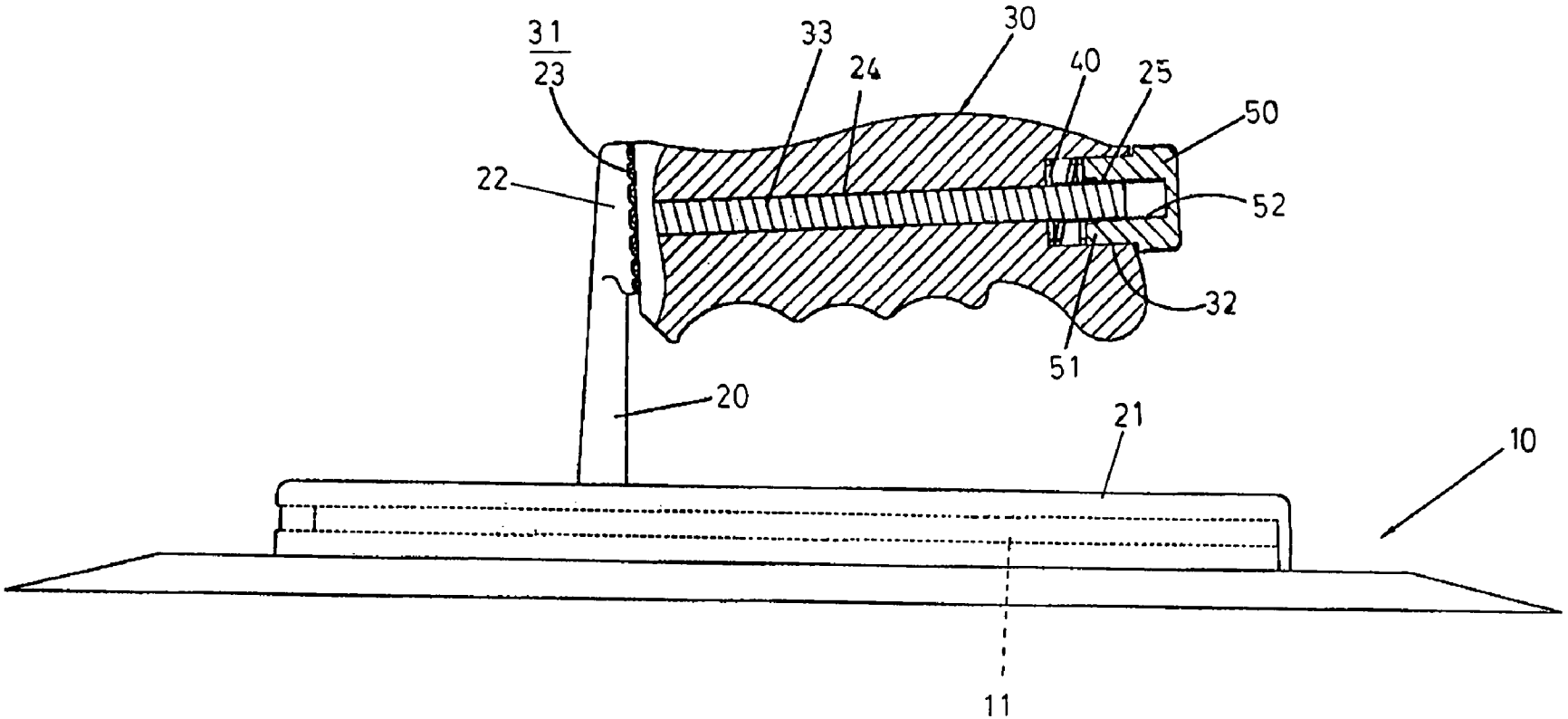
FIG. 2 is the cut-away view for the assembly of the invention.
Figure 3:
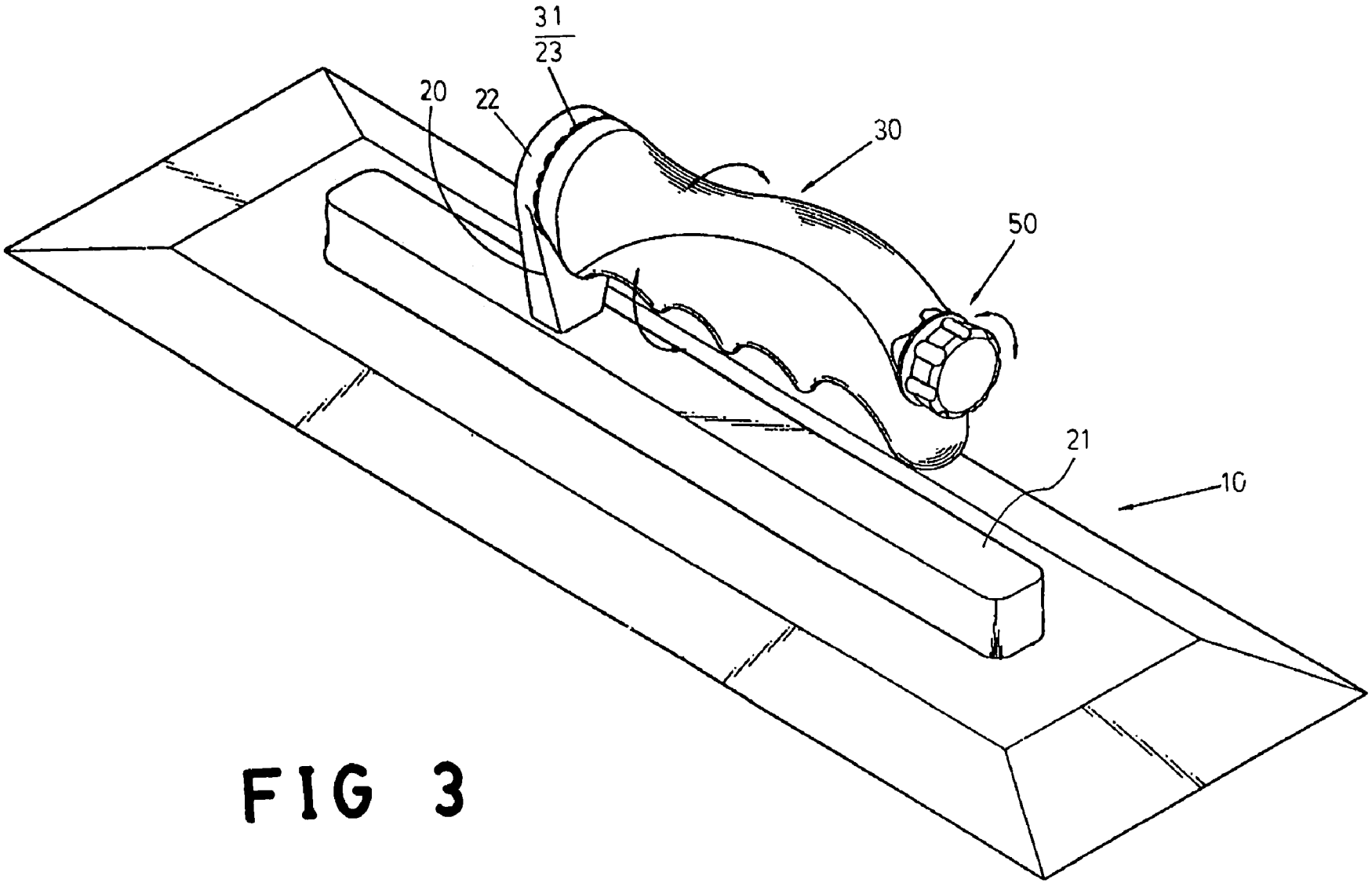
FIG. 3 is the three-dimensional operational diagram for the invention.

| [Symbol descriptions] | |
|---|---|
| 10 blade | 11 tongue |
| 20 connecting section | 21 base |
| 22 supporting end | 23 toothed ring |
| 24 shaft | 25 screw section |
| 30 grasping section | 31 toothed ring |
| 32 accommodating hole | 33 through-hole |
| 40 spring | 50 adjustment knob |
| 51 terminal | 52 screw |

What is claimed is:

1. A structure for a hand trowel handle comprising:

a grasping section with a surface made of soft and slip-proof material and matches the shape of a human hand and having an adjustable rotational angle;

a front end with a toothed ring and a rear end that has an accommodating hole;

a through-hole that runs through the grasping section, toothed ring, and the accommodating hole;

a spring that is set and worn on the shaft in the accommodating hole;

an adjustment knob inserted into the accommodating hole after the spring;

a connecting section having a base to connect with a tongue and a blade forming one integrated body;

a supporting end of the connecting section having a toothed ring and a shaft with a screw section at the end protruding from the center of the toothed ring, wherein the adjustment knob connects to the screw section, and wherein the adjustment knob can be tightened to change the angle between the grasping sections and the blade.

2. The structure according to claim 1 for a hand trowel handle with adjustable rotational angle on the grasping section, wherein the toothed rings for the grasping section and the connecting section are radial.

3. The structure according to claim 1 for a hand trowel handle with adjustable rotational angle on the grasping section, wherein the matching of the toothed rings of the grasping section and the connecting section is achieved by tightening the adjustment knob and a spring pushing the inner side of the accommodating hole at the rear end of the grasping section.

* * * * *